United States Patent [19]

Okada et al.

[11] 4,436,352

[45] Mar. 13, 1984

[54] KITCHEN FURNISHINGS

[75] Inventors: Yoshio Okada, Katano; Yoshiaki Suzuki, Suita; Ryohei Murakami, Habikino; Yoshiaki Segawa, Nishinomiya, all of Japan

[73] Assignee: Matsushita Electric Industrial Co., Ltd., Kadoma, Japan

[21] Appl. No.: 314,096

[22] PCT Filed: Feb. 16, 1981

[86] PCT No.: PCT/JP81/00029

§ 371 Date: Oct. 15, 1981

§ 102(e) Date: Oct. 15, 1981

[87] PCT Pub. No.: WO81/02382

PCT Pub. Date: Sep. 3, 1981

[30] Foreign Application Priority Data

Feb. 20, 1980 [JP] Japan ..... 55-20713

[51] Int. Cl.[3] ..... A47B 77/06; A47L 19/02

[52] U.S. Cl. ..... 312/228; 312/229; 312/238; 211/41

[58] Field of Search ..... 312/229, 228, 206, 238, 312/198; 211/41

[56] References Cited

U.S. PATENT DOCUMENTS

| | | | |
|---|---|---|---|
| 475,052 | 5/1892 | Brahe | 312/228 |
| 531,956 | 1/1895 | Miller et al. | 312/229 |
| 542,912 | 7/1895 | Wood | 211/41 |
| 757,003 | 4/1904 | Wilcox | 312/229 |
| 912,168 | 2/1909 | Reese | 312/229 |
| 2,254,431 | 9/1941 | Levine | 312/229 |
| 2,313,690 | 3/1943 | White | 312/238 |
| 2,328,129 | 8/1943 | Earle | 312/229 |
| 2,418,919 | 4/1947 | Benson | 211/41 |
| 2,538,233 | 1/1951 | Brandstrom | 312/229 |
| 2,550,539 | 4/1951 | Earle | 312/228 |
| 2,580,784 | 1/1952 | Hoppe | 312/228 |
| 3,407,016 | 10/1968 | Kronenberger | 312/229 |
| 4,084,867 | 4/1978 | Putt et al. | 312/229 |

FOREIGN PATENT DOCUMENTS

| | | | |
|---|---|---|---|
| 520156 | 3/1955 | Italy | 312/198 |
| 249664 | 4/1926 | United Kingdom | 312/228 |

*Primary Examiner*—Victor N. Sakran

*Attorney, Agent, or Firm*—Wenderoth, Lind & Ponack

[57] ABSTRACT

This invention relates to a kitchen furnishings wherein a storage cabinet is arranged in an eye-level space above a work top with a sink laterally of the work top, which storage cabinet is provided with front and rear rack assemblies slidable from within the cabinet to above the work top adjacent the sink, a drain tray being provided within the cabinet for catching water drops from items placed on the rack assemblies to dry.

6 Claims, 12 Drawing Figures

KITCHEN FURNISHINGS

FIELD OF THE INVENTION

This invention relates to kitchen furnishings provided with a storage cabinet for the storage of kitchen items such as kitchenware, kitchen appliances, and tableware in three dimensions.

BACKGROUND ART

Appearances of various cabinets constituting kitchen furnishings have now come to be considered generally important. This is for the reason that the recent trend is to use a kitchen not only as a cooking workshop, but also as a part of a living room and/or a dining room.

Even though kitchen furnishings have now come to be beautifully finished, placement of kitchen appliances used there, as well as exposed tableware storage vessels and rack shelves tends to diminish the appearance of the kitchen furnishings and, possibly, to impair the atmosphere of a happly family circle. Specifically, while the kitchen furnishings include various cabinets for accommodating the various kitchen items, for example, a base cabinet supporting a countertop (work top) thereon, a tableware cabinet (cup-board) positioned, for example, laterally thereof and a wall-mount rack suspended from a kitchen wall above the work top, what is stored in these cabinets are some of the kitchen items which are not regularly used and, on the other hand, some of the kitchen items which are regularly used everyday, for example, tableware used at each meal time, as well as bakeware, a chopping board, a cleanser and others are often left placed in a storage vessel and on a drain rack both provided around a sink.

This is for the reason that the conventional kitchen furnishings are such that the sink area, where is the center of the kitchen workshop, and the cabinets for accommodating the various kitchen items are not coordinated to each other. In addtion, there is provided no storage cabinet effective to store all such kitchen items which are regularly used everyday. In other words, with the conventional kitchen furnishings, in order to place in a storage cabinet kitchen items which have been cleansed at the sink area, much labor is required to distribute the cleansed kitchen items to appropriate cabinets, e.g., to place the tableware, the bakeware and the chopping board respectively in the cupboard, the wall-mount cabinet and the base cabinet either after they have been temporarily stored in the storage vessel and/or drain rack and subsequently dried with a cloth or after they have been allowed to stand for a predetermined period of time for drainage and drying. Because of the labor required as described above, no one, but a person regular in his or her habits, will regularly place the kitchen items in the storage cabinets each time they have been used, and one generally tends to leave them on the storage vessels and/or the drain rack around the sink area.

Thus, with the conventional kitchen furnishings, the kitchen items regularly used tend to be left placed in the storage vessels and/or the drain rack around the sink area and, accordingly, not only these kitchen items, but also the storage vessels as well as the drain rack for the support thereof diminish the appearance of the kitchen.

SUMMARY OF THE INVENTION

Accordingly, this invention has been designed to improve both pleasant appearance and the handling easiness by providing laterally of and above the work top having a sink with a storage cabinet effective to store kitchen items in three dimensions.

An embodiment of this invention will now be described with reference to the accompanying drawings.

BRIEF DESCRIPTION OF THE DRAWINGS

The drawings illustrate an embodiment of this invention, wherein.

DETAILED DESCRIPTION OF THE PREFERRED EMBODIMENT

Figure 1:
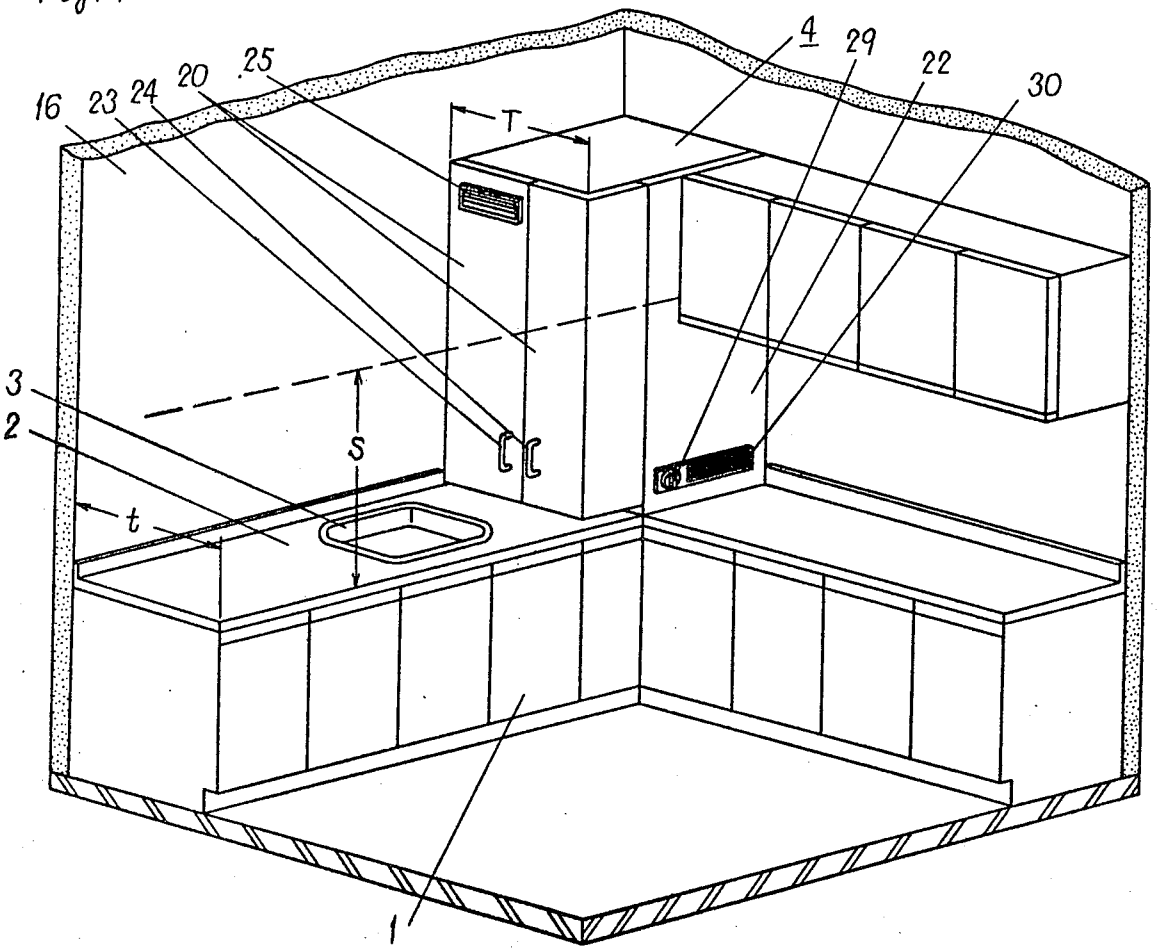
FIG. 1 is a perspective view of the entire arrangement of kitchen furnishings.
Figure 2:
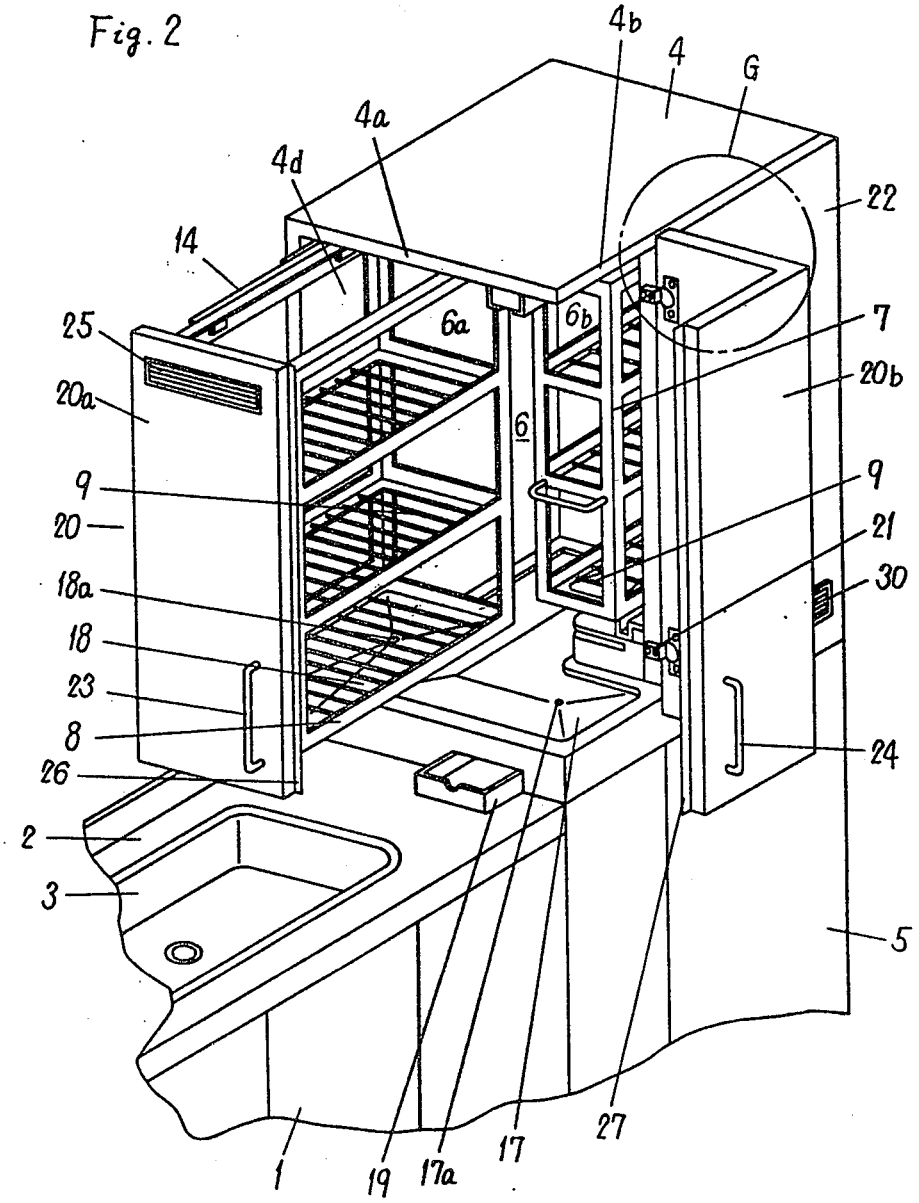
FIG. 2 is a perspective view.
Figure 3:
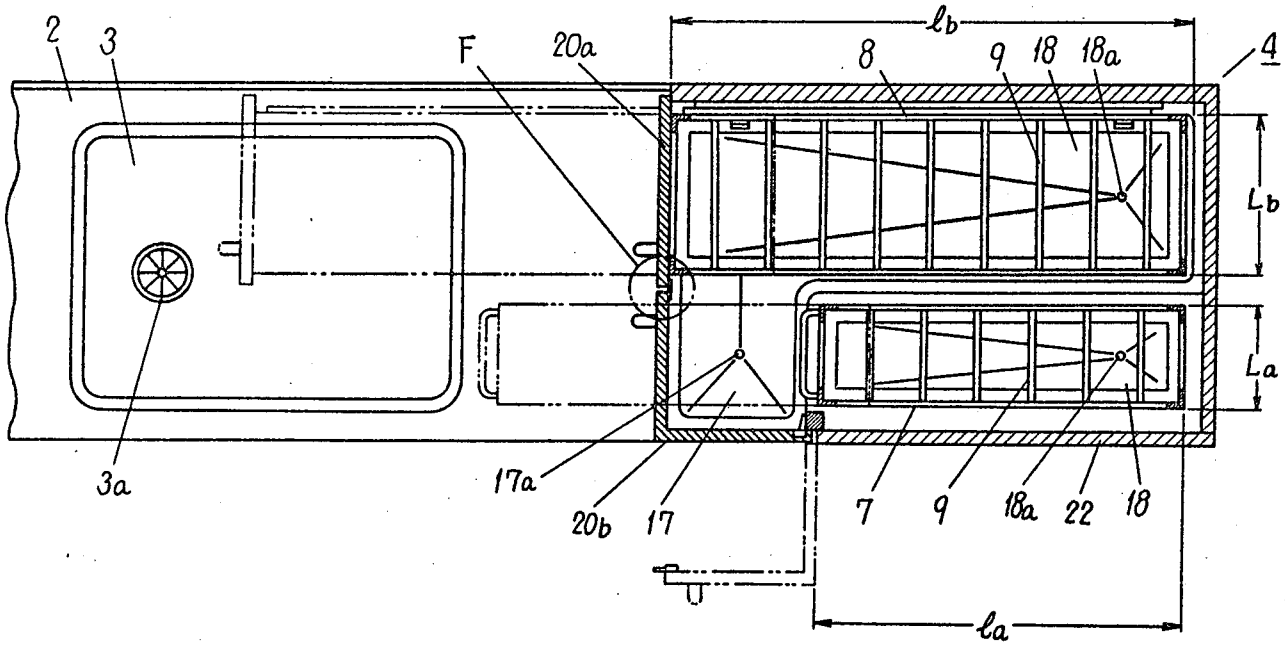
FIG. 3 is a cross-sectional view of the same.
Figure 4:
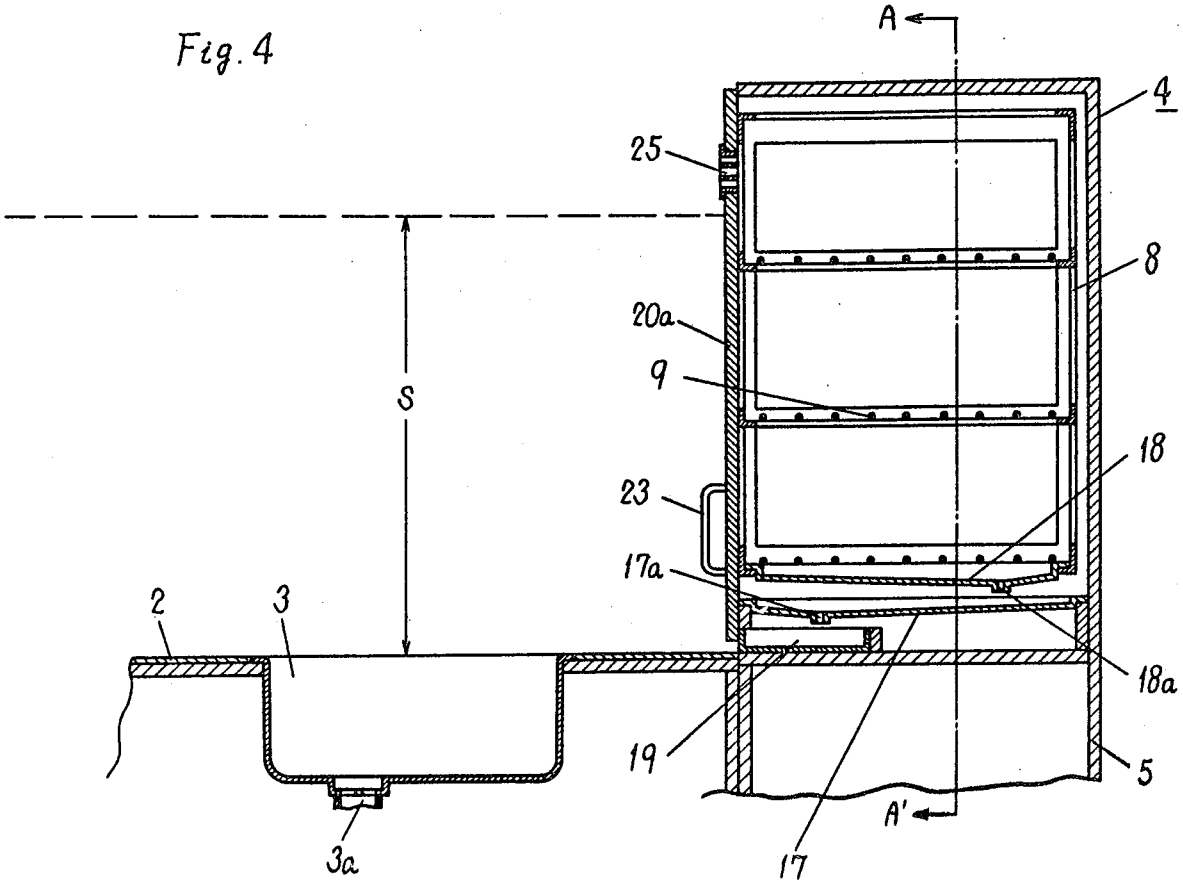
FIG. 4 is a longitudinal sectional view of the same with rack assemblies accommodated inside a storage cabinet.
Figure 6:
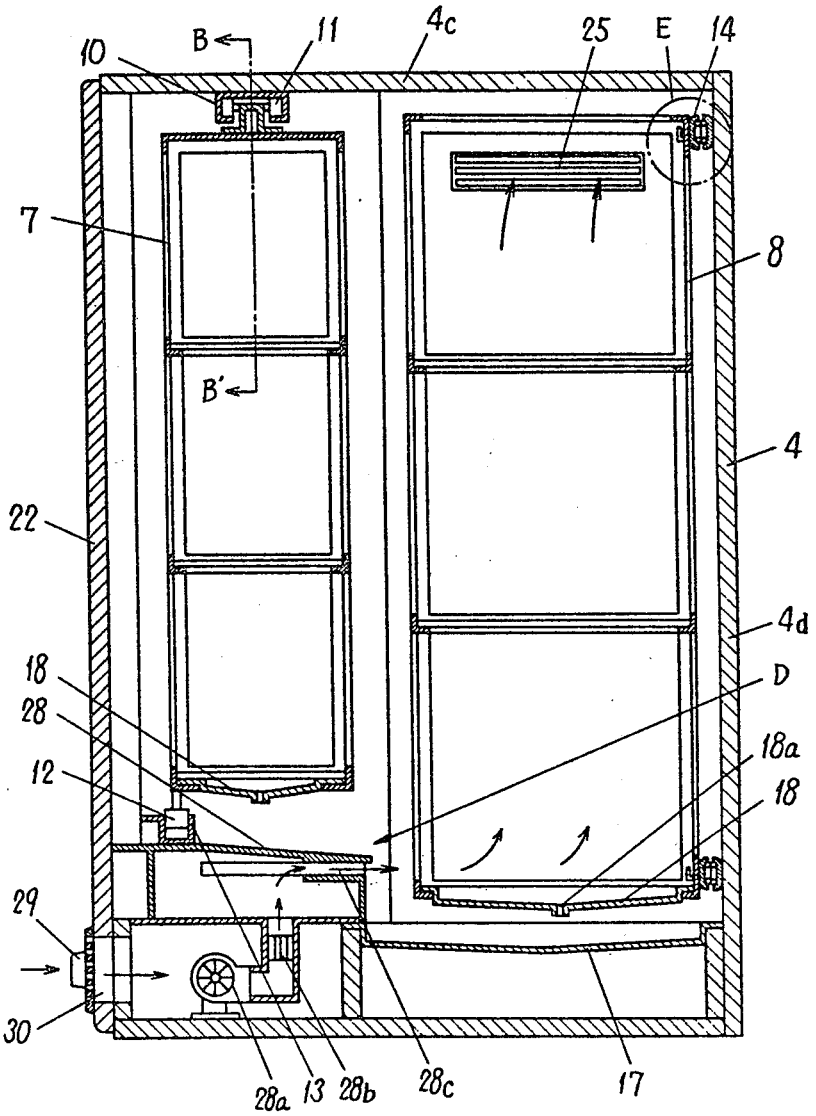
FIG. 6 is a cross-sectional view taken along A–A′ in FIG. 4.
Figure 7:
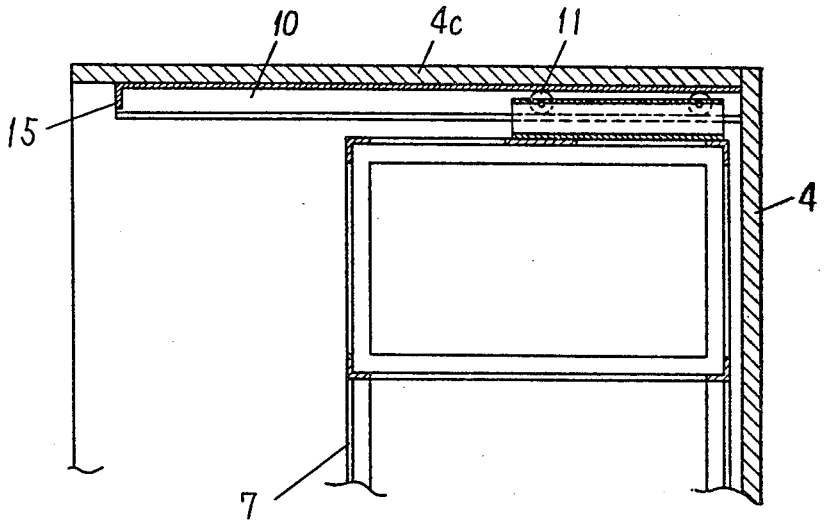
FIG. 7 is a partial cross-sectional view taken along B–B′ in FIG. 6.
Figure 8:
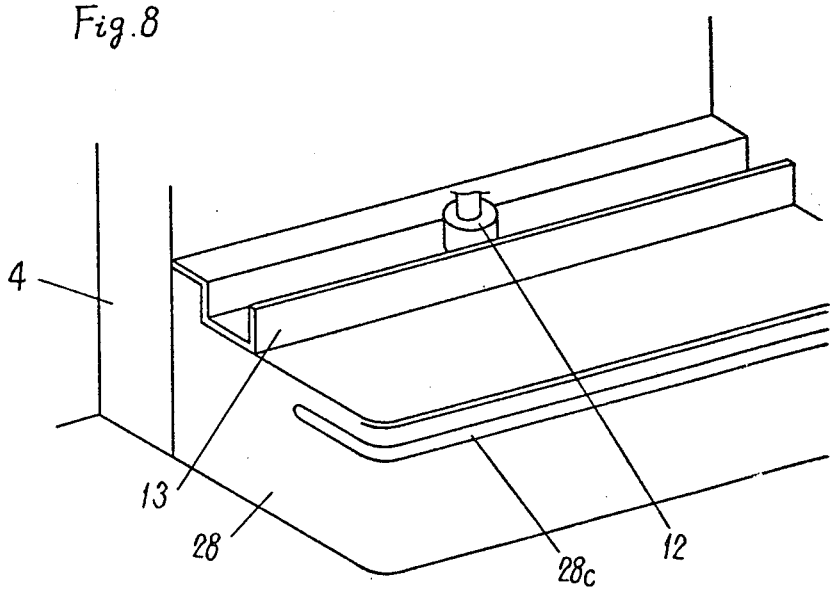
FIG. 8 is a perspective view, on an enlarged scale, of a portion of FIG. 6 as viewed in a direction of the arrow D.
Figure 9:
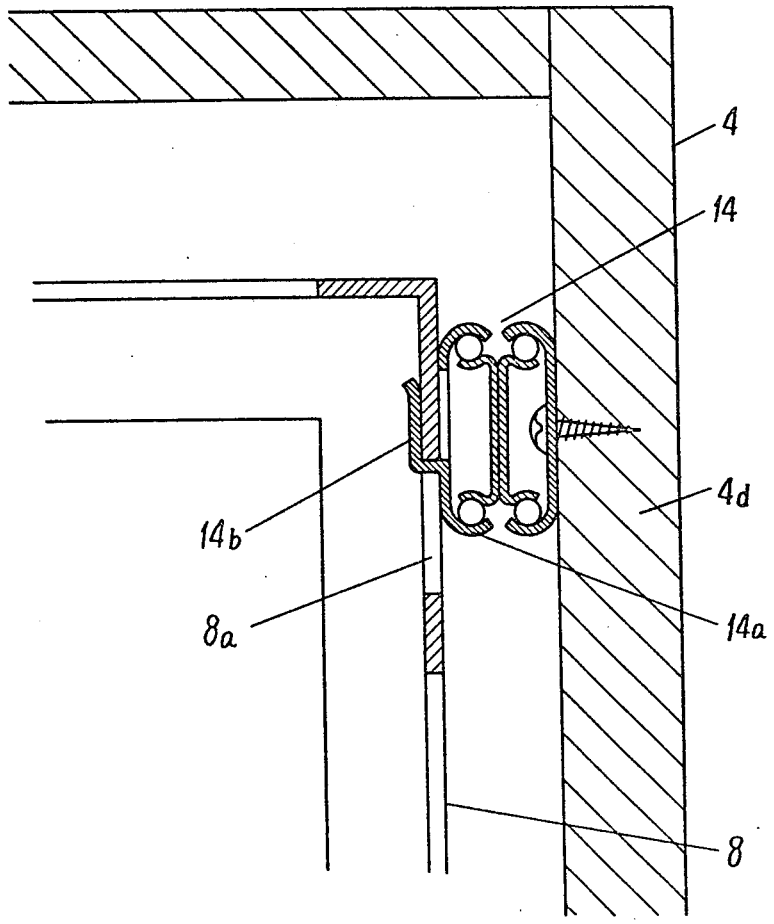
FIG. 9 is a sectional view, on an enlarged scale, of a portion E in FIG. 6.
Figure 10:
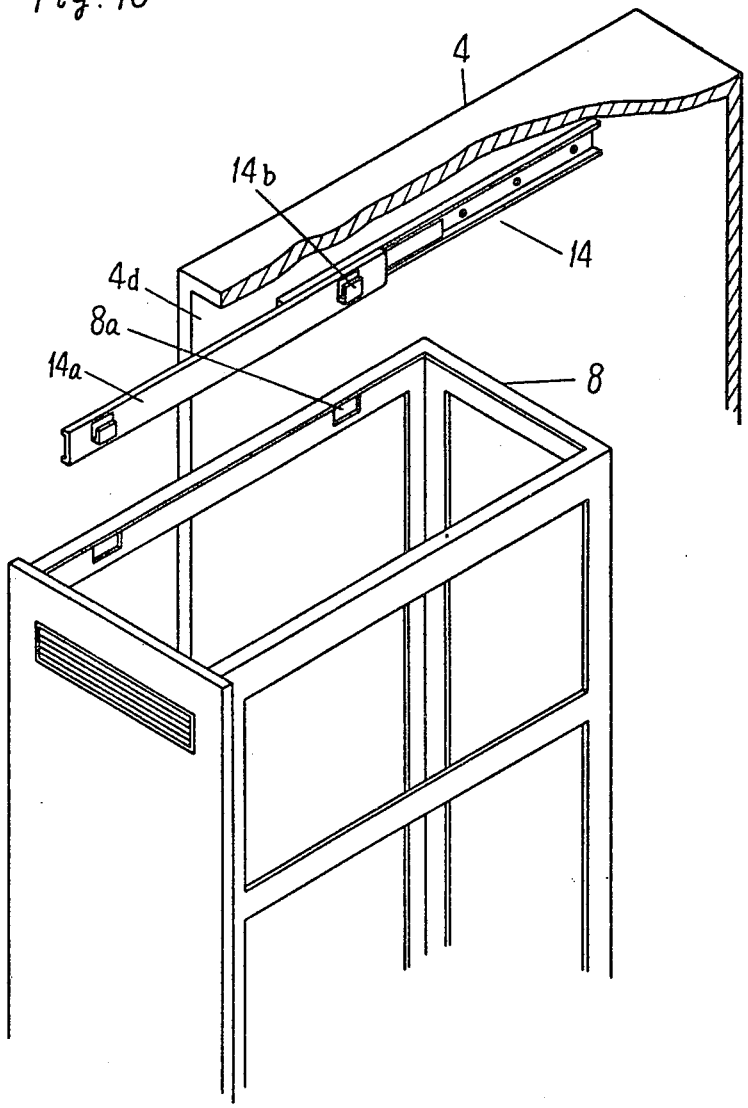
FIG. 10 is an exploded view, with a portion broker away, showing an engagement between the rear rack assembly and a suspension rail.
Figure 11:
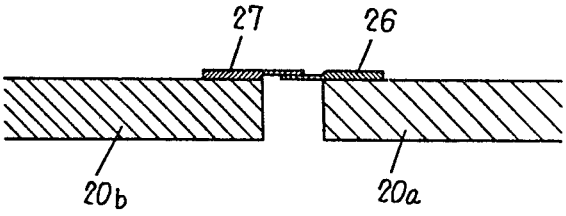
FIG. 11 is a sectional view, on an enlarged scale, of a portion F in FIG. 3.
Figure 12:
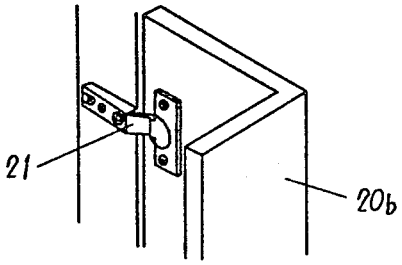
FIG. 12 is a perspective view, on an enlarged scale, of a portion G in FIG. 2.

FIG. 1 shows a base cabinet countertop supporting a (work top) 2, a sink 3 defined in the work top 2, and a storage cabinet 4 arranged in an eye-level space S at a position laterally of the sink 3 and having its longitudinal width T approximately equal to the longitudinal width t of the work top 2, which storage cabinet may be placed directly on the work top 2 although in the preferred embodiment disclosed herein it is mounted on a stand 5 positioned adjacent the base cabinet 1 as shown in FIG. 2. An opening 6 is defined along a side wall 4*a* of the storage cabinet 4 facing the sink 3 and a side wall 4*b* contiguous to side wall 4*a*, which opening is constituted by mutually communicating side opening 6*a* and front opening 6*b*. Rack assemblies 7 and 8 are provided in the storage cabinet 4 in side-by-side relation and provided with rack shelves 9 one above the other for the accomodation of kitchen appliances, the longitudinal widths La and Lb of these rack assemblies 7 and 8 being approximately half the longitudinal width T of the storage cabinet 4 as shown in FIG. 3. The transverse width la of the front rack assembly 7 is made smaller than the transverse width lb of the rear rack assembly 8 positioned behind rack assembly 7. These rack assemblies 7 and 8 can be drawn out from the interior of the storage cabinet 4 through the front opening 6*a* to positions respectively above the sink 3 and to the eye-level space S designated in FIG. 4 above the work top 2 adjacent the sink 3 as shown by the phantom lines in FIG. 3 and are movably fitted to the storage cabinet 4. While means for fitting rack assemblies 7 and 8 can be contemplated in numerous ways, in the illustrated embodiment the front rack assembly 7 is suspended by a rail 10 rigidly secured to a top wall 4c of the storage cabinet 4 and rollers 11 rigidly mounted on the top of the front rack assembly 7 and engaged to the rail 10 as shown in FIGS. 6 and 7. In this case, since this manner of suspension is insufficient in that a lower portion of the front rack assembly 7 is unstable during the movement, the front rack assembly 7 is provided at one side of the lower portion thereof with rollers 12, as shown in FIGS. 6 and 8, which are engaged to a rail 13 rigidly secured to the bottom of the storage cabinet 4. In the case of the rear rack assembly 8, as shown in FIGS. 6, 9 and 10, the rear rack assembly 8 is suspended on movable rails 14a of suspension rail assemblies 14 provided at upper and lower portions of a rear wall 4d of the storage cabinet 4, and, for this purpose, the movable rails 14a are formed with hooks 14b while the rear rack assembly 8 is formed with apertures 8a for the insertion of the hooks 14b therethrough.

Figure 5:
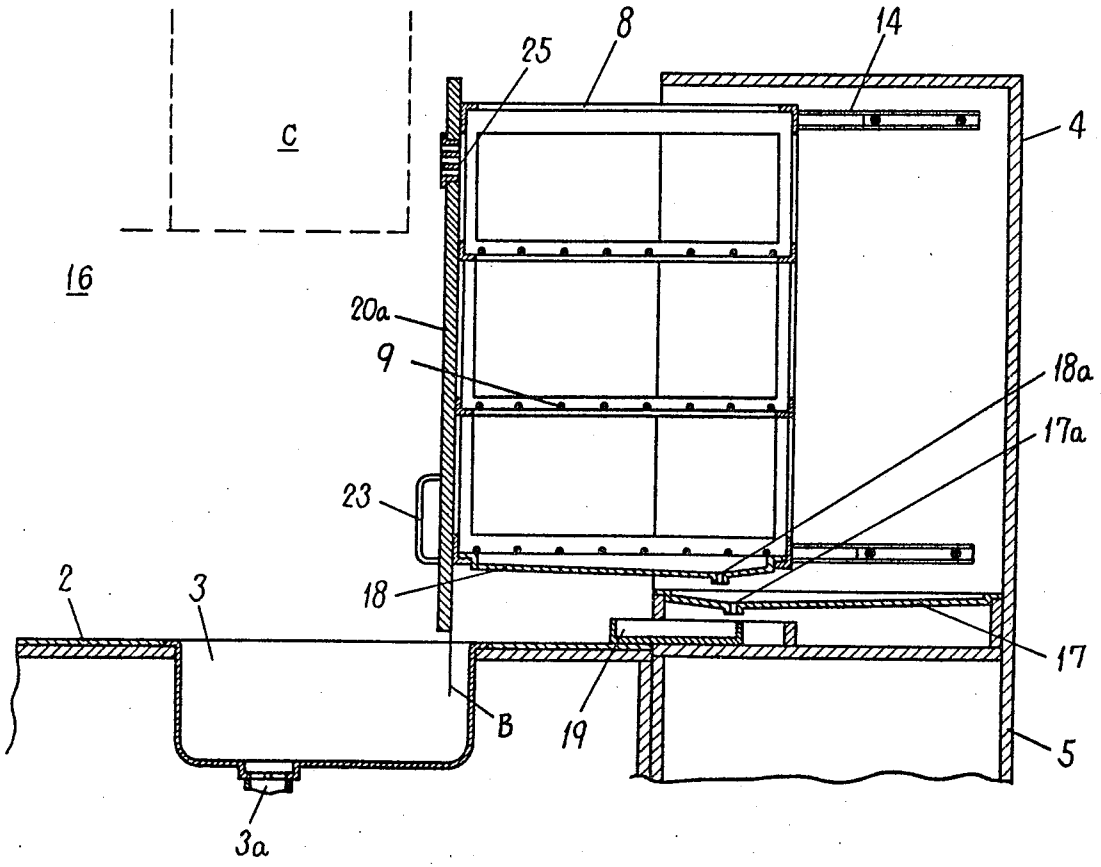
FIG. 5 is a longitudinal view of the same with the rack assemblies drawn out of the storage cabinet.

The rail 10 movably supporting front rack assembly 7 is, as shown in FIG. 7, provided with a stopper 15 against which the roller 11 abuts for avoiding any possible derailment of the front rack assembly 7 from the rail 10. Although not shown, the suspension rail assemblies 14 for the rear rack assembly 8 are also provided with similar stoppers. These stoppers serve to restrict the maximum drawable distance over which the rack assemblies 7 and 8 can be drawn out from the storage cabinet 4 and, as shown in FIG. 5, it must be such that the leading sides of the rack assemblies 7 and 8, that is, the front ends B of the rack assemblies can be drawn at least to a position adjacent the sink 3. In practice, it suffices that when a person stands frontwardly of the sink 3 for cleansing kitchen items, the rack assemblies 7 and 8 can be drawn to the position where the person can reach them without being forced to move or with a slight movement. However, the maximum drawable distances for the rack assemblies 7 and 8 should be determined in consideration of the space available above the sink 3. That is to say, if the maximum drawable distances for the rack assemblies 7 and 8 are too large, the space above the sink 3 will be occupied by the rack assemblies 7 and 8, so that it will be difficult for the person to perform a cleansing work at the area adjacent the sink 3 and the space required to accommodte objects, such as, wall-mount cabinets C secured to a building wall 16 above the sink 3 will be minimized. In view of this, in the illustrated embodiment, so that the rack assemblies 7 and 8 would not occupy the entire space above the sink 3, as shown by the phantom lines in FIG. 3, the maximum drawable distances for the rack assemblies 7 and 8 are selected to terminate adjacent the sink 3 and adjacent a central area of the sink 3, respectively. Needless to say, where the wall-mount cabinet C is positioned in a space ranging from above the central area of the sink 3 to the vicinity of the storage cabinet 4 as shown in FIG. 5, the maximum drawable distance for the rear rack assembly 8 may also terminate adjacent the sink 3. A drain tray 17 is arranged at the bottom of the storage cabinet 4 for receiving water drops falling from kitchen items placed on the rack shelves 9 in the rack assemblies 7 and 8. However, in the illustrated embodiment, drain trays 18 are provided respectively at the bottoms of the rack assemblies 7 and 8 so that the drain tray 17 can receive the water drops indirectly. In other words, the drain trays 18 are formed with a drain hole 18a through which the water drops falling onto the drain trays 18 reach the drain tray 17 through the drain hole 18a.

The reason for the prevision of the drain trays 18 also at the bottoms of the rack assemblies 7 and 8 is to avoid the water drops falling onto the work top 2 when the rack assemblies 7 and 8 are drawn out as shown in FIG. 5, although the use of the drain tray 18 may not be always necessary because the work top 2 is waterproofed. However, the use of the drain trays 18 renders it unnecessary to wipe with a cloth the water drops which would otherwise fall onto the work top 2. In addition, where the drain trays 18 are provided, it is preferred to design them such that the water drops falling onto the drain trays 18, can fall onto the drain tray 17 through the drain holes 18a without being accumulated in the drain trays 18 not only when the rack assemblies are inside the storage cabinet 4, but also when they are drawn out. This is because, if the drain trays 18 are so designed as to carry the water drops, there is a possibility that the water in the drain trays 18 would be split during the movement of the rack assemblies 7 and 8, and, in the illustrated embodiment, the maximum drawable distances for the rack assemblies 7 and 8 are so adjusted that, while the drain holes 18a are positioned rearwardly in the rack assemblies 7 and 8, they always faces the drain tray 17 even when the rack assemblies 7 and 8 are drawn out over the full maximum drawable distance.

The water drops reaching the drain tray 17 may be drained occasionally by making the drain tray 17 removable relative to the storage cabinet 4, but in the illustrated embodiment, the drain tray 17 is formed with a drain hole 17a, below which a water receptacle 19 is provided so as to be removable from below the side wall 4a of the storage cabinet 4 so that the water collected therein can be drained occasionally. Other drainage means can be contemplated to communicate the drain hole 17a to a drain pipe 3a through a drain hose so that the water can be successively drained without being collected in the drain tray 17.

A door assembly 20 is provided for closing and opening the opening 6 of the storage cabinet 4 and is, as shown in FIG. 2, composed of a door 20a rigidly secured to one side of the rear rack assembly 8 and a door 20b connected pivotally to the storage cabinet 4 by means of hinges 21, door 20a being adapted to close and open about half the side opening 6a while the door 20i b is adapted to close and open the remaining half of the side opening 6a and the front opening 6b continuous thereto.

Although in the illustrated embodiment the door assembly 20 is divided into a plural number of doors, one door 20a secured to the rear rack assembly 8 and the other door 20b pivotable, it may be composed of a single door or, in the case of the door assembly 20 composed of separate doors, both may be made pivotable. However, where it is composed of a single door, the door would become large in size providing an obstacle and, in the case where both doors are made pivotable, that is, in the case where the door used to close and open about half the side opening 6a facing the side of the rear rack assembly 8 is also made pivotable, the latter door would provide an obstacle in a space above the work top 2. However, when the door assembly 20 is made in divided constraction as in the illustrated embodiment, the doors 20a and 20b can be minimized in size, providing no obstacle and, if the door 20a which comes to a position above the work top 2 is fixed, the space above the work top 2 is not be obstructed. Moreover, in the illustrated embodiment, in order that the pivotable door 20*b* have a minimized size so as not to provide an obstracle, the front opening 6*b* of the storage cabinet 4 is formed along approximately ¼ of the front wall 4*b*, the remaining portion of the front wall 4*b* being covered by a blind patch 22.

Handles 23 and 24 are respectively secured to the doors 20*a* and 20*b*, a ventilating aperture 25 is formed in an upper portion of the door 20*a*, and band-shaped packings 26 and 27 are respectively provided at the opposed side edge portions of the doors 20*a* and 20*b* and operable to contact each other, when the doors 20*a* and 20*b* are closed, to avoid intrusion of dust, insects and other airborne objects and materials into the storage cabinet 4.

In the construction as hereinabove described, since the rack assemblies 7 and 8 are so designed as to be drawn out to the eye-level space S above the work top 2 and at least adjacent the sink 3, when the cleansing of the kitchen items is performed at the area adjacent the sink 3, the person can place the cleansed kitchen items successively on the rack shelves 9 in the rack assemblies 7 and 8 while he or she stays at the sink 3 or moves a slight distance therefrom. Also, the kitchen items placed on the rack shelves 9 can be accommodated within the storage cabinet 4 simply by moving the rack assemblies 7 and 8 into the storage cabinet 4 and, if the opening 6 is subsequently closed by the door assembly 20, the kitchen furnishings present an orderly appearance.

The kitchen items accommodated within the storage cabinet 4 are naturally dried during such accommodation. However, it is also possible to forcibly dry them by providing the storage cabinet 4 with a drying means as shown in FIG. 6. In particular, a drier body 28 within which there is provided a fan 28*a*, operated by a control knob 29 arranged exteriorly in the blind patch 22, and a heater 28*b* can be provided. By driving the fan 28*a* outside of the storage cabinet 4 can be drawn into the body 28 through the ventilating aperture 30 formed in the blind patch 22 and, after having been heated by the heater 28*b*, flows in the form of warm air, as shown by the arrows, into the storage cabinet 4 through a discharge opening 28*c* defined in the body 28. The discharge opening 28*c* is formed in a side perimeter of the body 28 in an elongated configuration as shown in FIG. 8 so that the warm air can be distributed uniformly within the storage cabinet 4.

The rack assemblies 7 and 8 have been described as arranged frontwardly and rearwardly in side-by-side relation. This is because, two requirements to increase the capacity of the storage cabinet 4 to accommodate as many kitchen items as possible and to make it easy to deposit and withdraw the kitchen items can be satisfied at the same time. In other words, only to increase the capacity would be satisfied by providing a single rack assembly of a longitudinal width approximating to the longitudinal width T of the storage cabinet 4 and, in such case, depositing and withdrawing of the kitchen items into and from the deepest area of the single rack assembly cannot easily be performed unless some kitchen items located on the side opposite to the deepest area are removed. Accordingly, the side-by-side arrangement of the rack assemblies 7 and 8 such as in the illustrated embodiment makes it easy to deposit and withdraw the kitchen items into and from the rear rack assembly 8 only by drawing the rear rack assembly 8 out from the storage cabinet 4 while the front rack assembly 7 remains inside the storage cabinet 4 as shown in FIG. 3.

Moreover, in the illustrated embodiment, the opening 6 of the storage cabinet 4 has been described as formed continuously from the side wall 4*a* to the front wall 4*b* of the storage cabinet 4, and this is for the reason described below. Namely, in order to acquire a space for accommodating as many articles as possible in a narrow kitchen, it is usual to mount the wall-mount cabinet C to the building wall 16 adjacent the storage cabinet 4 as shown in FIG. 5 and, as a result thereof, it may happen that a space above the work top 2 and laterally of the storage cabinet 4 would not be available to such an extent as to permit the rack assemblies 7 and 8 to be fully drawn out from the storage cabinet 4 and that rear portions of the rack assemblies 7 and 8 would therefore remain inside the storage cabinet 4. In such a case, the provision of only the side opening 6*a* would make it extremely hard to deposit and withdraw some kitchen items into and from the rear portions of the rack assemblies 7 and 8 which remain inside the storage cabinet 4. Therefore, the provision of the front opening 6*b* in addition to the side opening 6*a* makes it easy to deposit and draw the kitchen appliances since the rear portions of the rack assemblies 7 and 8 face the front opening 6*b* as shown in FIG. 3. It is to be noted that, in the illustrated embodiment, in order to minimize the size of the pivotable door 20*b*, the front opening 6*b*, is limited to about ¼ of the front wall 4*b* of the storage cabinet 4. Although this opening dimension may be larger than that described above depending on the extent to which the rear portions of the rack assemblies 7 and 8 remain inside the storage cabinet 4, a larger opening dimension requires that the door 20*b* be of increased size and, therefore, it is preferable to limit the opening dimension to a maximum of about ½ of the front wall 4*b*. If it is about ½, the depositing and withdrawing of the kitchen items would not be hampered since the rear portions of the rack assemblies 7 and 8 remaining inside the storage cabinet 4 even if they are too large can be positioned adjacent the side opening 6*b*. Moreover, in the illustrated embodiment, the transverse width la of the front rack assembly 7 is made smaller than the transverse width lb of the rear rack assembly 8 and this is for the purpose of maximizing the amount of the rear portion of the rear rack assembly 8 remaining inside the storage cabinet 4 which can confront opening 6 as shown in FIG. 2, so that the depositing and withdrawing of the kitchen items relative to the rear rack assembly 8 can be facilitated.

As hereinbefore described, since this invention is such that the kitchen items can essentially be stored collectively in the storage cabinet during the performance of the cleansing of the kitchen items at the sink area, not only can the kitchen furnishings be maintained in good order, but also the atmosphere of a family circle can be kept pleasant. Moreover, since the opening of the storage cabinet opens wide from the side wall of the storage cabinet to the front wall contiguous thereto, the depositing and withdrawing of the kitchen items relative to the rack assemblies can readily be performed and, therefore, kitchen work can efficiently be performed.

What is claimed is:

1. A kitchen arrangement comprising:

a. a sink having a front side facing frontward, a rear side facing rearward, and two opposite sides connecting said front and rear sides, one of said two sides having an upper side edge;

b. a countertop adjacent said upper side edge on said one of said two sides of said sink defining an open space thereabove above said upper side edge; and c. a storage cabinet on said one of said two sides of said sink above said countertop and said upper side edge, adjacent said countertop and horizontally spaced from said upper side edge, said cabinet including:

(1) outer walls defining an interior space therein, including a near side wall facing said sink, and a frontward facing front wall contiguous to said near side wall, a continuous opening being provided in said near side wall and in said front wall, (2) a plurality of rack assemblies having rack shelves mounted thereon, slidably mounted to said outer walls within said interior space forwardly and rearwardly side-by-side for movement toward and away from said sink, such that said rack shelves are freely movable between said interior space and said open space adjacent said sink, and (3) a lower drain tray within said interior space below said rack assemblies for receiving water drops falling from any items accommodated on said rack shelves.

2. A kitchen arrangement as in claim 1, wherein said outer walls have ventilation apertures in the upper and lower portions thereof.

3. A kitchen arrangement as in claim 1, wherein said storage cabinet includes a fan within said outer walls for providing ventilation in said interior space.

4. A kitchen arrangement as in claim 1, wherein said outer walls include a far side wall opposite said near side wall facing away from said sink, each of said plurality of rack assemblies including a movable drain tray beneath the rack shelf thereof and above said lower drain tray, having a drain hole which is adjacent said far side wall when said each of said plurality of rack assemblies is within said interior space, each of said plurality of rack assemblies including means for restricting movement thereof such that said drain hole is always within said interior space above said lower drain tray.

5. A kitchen arrangement as in claim 1, wherein said plurality of rack assemblies includes a front assembly adjacent said front wall and a rear assembly, said cabinet further comprises a first door fixed to said rear assembly for movement with said rear assembly so as to close about one-half of the portion of said opening in said front wall, and a pivotable door for closing substantially the remainder of said opening.

6. A kitchen arrangement as in claim 1, wherein said plurality of rack assemblies includes a front assembly adjacent said front wall and a rear assembly, the width of said front assembly being smaller that the width of said rear assembly wherein said widths are measured in a direction perpendicular to said front wall.

* * * * *